US006074092A

United States Patent [19]

Andrews

[11] Patent Number: 6,074,092

[45] Date of Patent: Jun. 13, 2000

[54] COOLING SYSTEM FOR AN X-RAY SOURCE

[75] Inventor: Greg Andrews, Sandy, Utah

[73] Assignee: Varian Medical Systems, Inc., Palo Alto, Calif.

[21] Appl. No.: 09/162,316

[22] Filed: Sep. 28, 1998

[51] Int. Cl.[7] ..... H01J 35/10

[52] U.S. Cl. ..... 378/200; 378/141; 417/423.1

[58] Field of Search ..... 378/4, 130, 141, 378/199, 200, 201, 202; 417/423.1

[56] References Cited

U.S. PATENT DOCUMENTS

| | | | |
|---|---|---|---|
| 4,780,901 | 10/1988 | Gabbay et al. | 378/141 |
| 4,984,261 | 1/1991 | Maldonado et al. | 378/202 |
| 5,222,118 | 6/1993 | Gerth | 378/200 |
| 5,313,512 | 5/1994 | Tanaka | 378/200 |
| 5,357,555 | 10/1994 | Gerth | 378/200 |
| 5,732,123 | 3/1998 | Peralta et al. | 378/199 |

*Primary Examiner*—David P. Porta
*Attorney, Agent, or Firm*—Bradford L. Friedman; Bella Fishman

[57] ABSTRACT

The present invention is directed to a cooling system and apparatus for use in radiographic devices having high output x-ray tubes. In operation, the x-ray tube generates large amounts of heat that must be removed so as to prevent damage to the tube. In the present invention, the x-ray tube is disposed within an x-ray tube housing that is connected within a closed fluid circuit through which circulates a coolant fluid. The fluid circulates through the x-ray tube housing and absorbs heat dissipated by the x-ray tube. Also connected within the closed fluid circuit is a heat exchange which cools the coolant fluid before it is recirculated back to the x-ray tube housing. Also connected within the closed fluid circuit is a centrifugal pump which continuously circulates the coolant fluid between the x-ray tube housing and the heat exchange device. The pump includes as an integral part a deformable bellows that accomodates any volume changes with the closed fluid system due to increases in temperature.

10 Claims, 3 Drawing Sheets

COOLING SYSTEM FOR AN X-RAY SOURCE

FIELD OF THE INVENTION

The present invention relates to an apparatus and system for removing excess heat generated by electrical components. More particularly, the present invention is directed to a cooling system for removing heat dissipated by a high power, high intensity x-ray source, such as x-ray tubes used in systems such as CT scanners and the like.

BACKGROUND OF THE INVENTION

In system utilizing electrical components, heat is often generated when electrical power is supplied to the component. With some components, the amount of heat generated can be substantial. In such an environment, the dissipated heat must be continuously removed so as to prevent overheating and damage to the component and/or surrounding electrical circuitry.

One common example of an electrical system in which overheating can be problematic is in systems utilizing high power x-ray tubes for commercial or medical applications. Such tubes are commonly found in various radiographic devices used, for instance in CT (computerized tomographic) scanning for x-ray imaging, x-ray lithography for producing integrated circuits, x-ray diffraction for analyzing materials, and the like. In such devices and applications, a high power, high intensity x-ray tube is arranged to direct radiation through a targeted region. Depending on the particular application, the radiation can be used in various ways. For instance, in a CT scanner, the radiation can be detected after it has passed through the region of interest of a patient's body with one or more detectors, and then analyzed to determine the distribution of absorption of the radiation. In the course of such a procedure, much heat is generated by the x-ray tube as a by-product of the x-ray energy generated. This heat must be continuously removed to prevent damage to the tube (and any other adjacent electrical components) and to increase the x-ray tube's overall service life.

Typically, heat is dissipated in such a device with a coolant liquid or fluid, such as a dielectric oil. In a cooling system of this sort, the x-ray tube is usually disposed within an x-ray tube housing, and a pump is used to continuously circulate the coolant fluid through the housing. Then, as heat is dissipated by the x-ray tube during its operation, at least some of it is absorbed by the coolant fluid. The heated coolant fluid is then passed to some form of heat exchange device, such as a radiative surface in the form of a heat exchanger. Air is passed over the heat exchange (usually with a fan or fans) and, since the air is at a lower temperature than the heated fluid, a portion of the heat is dissipated from the fluid to the outside air. The fluid is then recirculated by the pump back into the x-ray tube housing and the process repeated.

The cooling system of the sort described above is typically implemented with the x-ray tube housing, the pump, and the radiator all interconnected within a closed circulation system, i.e., the fluid circuit for the coolant fluid is not open to the atmosphere. Thus, when heat is generated by the x-ray tube, both the temperature and the volume of the coolant fluid within the closed system increase. As such, the closed system must provide some ability for accommodating volume within in the closed circulation system. Typically, the mechanism that provides this ability is a separate component, often referred to as an accumulator. Usually, an accumulator includes an expandable material, such as a rubber bladder or diaphragm, and a housing or similar structure for protecting the bladder or diaphragm. In known implementations, the accumulator is configured as a separate and discrete component that is interconnected somewhere within the closed circulation system. Consequently, it must include suitable fluid fittings and conduits so that it can be physically connected within the closed system. In operation, as the coolant fluid is heated, and the fluid volume within the closed system increases, the expandable bladder/diaphragm correspondingly expands and thereby maintains the integrity of the closed system. Conversely, a decrease in temperature and volume is also accommodated by a corresponding contraction of the flexible diaphragm.

As noted, in the prior art the accumulator is designed as a component separate and distinct from the rest of the components within the closed system. Such an approach has resulted in several undesirable characteristics, primarily due to the need for additional fluid connection points to physically connect the accumulator within the closed system. This gives rise to a need for additional parts and for additional assembly time and complexity, resulting in a system that is difficult to install, replace and repair. Moreover, additional fluid fitting interconnection points raise the probability that the system will leak coolant fluid during operation.

As such, there is a need for a system in which the accumulator is not implemented as a separate and discrete component within the closed system. This would eliminate the need to have additional fluid connection points within the closed system, and reduces the number of parts present. A reduction in parts reduces the overall complexity of the system, as well as the time needed for its initial assembly and subsequent servicing. In addition, reduction in fluid connection points reduces the chance for part failure and fluid leakage, and would provide a more reliable system.

SUMMARY OF THE INVENTION

The foregoing problems in the prior state of the art have been successfully overcome by the present invention, which is directed to a system for removing heat dissipated by a high intensity x-ray source, such as an x-ray tube used in radiographic equipment such as a CT scanner and the like. In the preferred embodiment, the cooling system operates within a closed circulation circuit and functions so as to continuously circulate a coolant liquid or fluid to the x-ray tube, which is disposed within an x-ray tube housing. The coolant then absorbs at least some of the heat dissipated by the tube during its operation as the coolant passes through the tube housing. The heated coolant is then preferably circulated through a means for removing heat from the coolant, such as a radiant surface implemented as a heat exchanger, at which point a portion of the heat present in the coolant is released to the air. The resulting coolant fluid, which has a lower temperature, is then recirculated back to the x-ray tube housing, and the process repeated.

In the preferred embodiment, the cooling system includes a means for pumping the coolant fluid in a predetermined direction through the closed circulation circuit, such as a centrifugal pump device. Because the coolant is circulated within a closed system (i.e., not open to atmosphere), when the tube heats the coolant, the coolant volume increases within the system. As such, the preferred embodiment also includes a means for accommodating volume changes within the closed circulation system. This volume accommodation means is preferably comprised of an accumulator fashioned as a bellows constructed with a flexible, deformable material. Moreover, the accumulator is formed as an integral part of the centrifugal pump, and in a manner so as to be in fluid communication with the coolant liquid. As coolant is circulated through the pump, the deformable accumulator thus accommodates for any coolant volume increase (or decrease) within the closed system by expanding and contracting as needed.

Integrating the accumulator as an integral component of the pump provides several key advantages. First, integration of the components eliminates the need to connect a separate accumulator within the closed circulation circuit, thereby eliminating the need for additional, fluid conduit connection points between the accumulator and the rest of the circuit. This reduces the overall complexity and number of parts within the cooling system, and simplifies its assembly and repair. Moreover, the reduction in fluid connection points reduces the chance of fluid leakage within the circuit, thereby increasing the overall reliability of the system.

Additional objects, features and advantages of the invention will be set forth in the description which follows, and in part will be obvious from the description, or may be learned by the practice of the invention. The objects and advantages of the invention may be realized and obtained by means of the instruments and combinations particularly pointed out in the appended claims. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawing depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
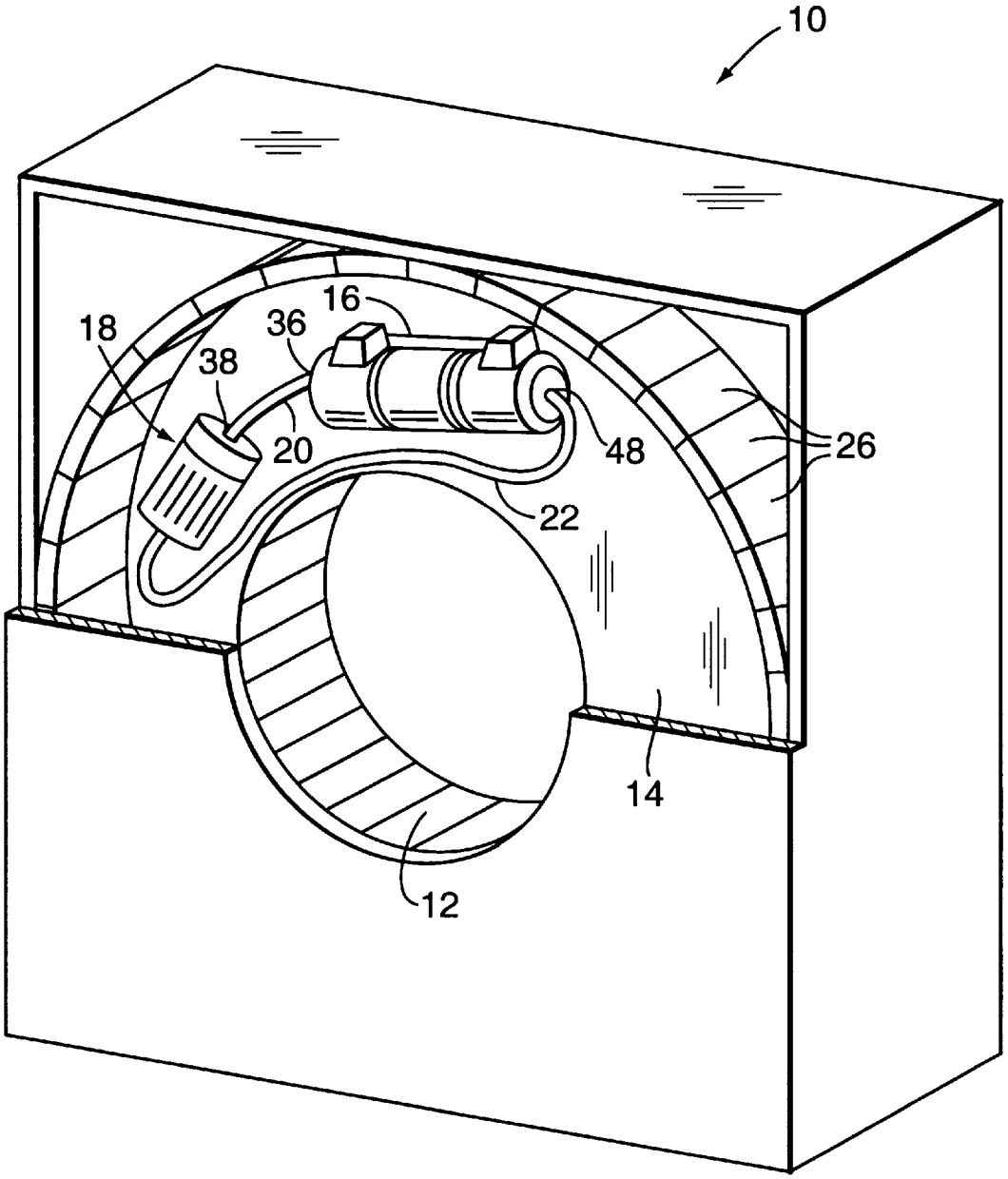
FIG. 1 shows an example of a radiographic device, sometimes referred to as a CT device, in which the cooling system of the present invention can be used to remove heat from an x-ray tube.

Reference is now to the drawings, in which reference numerals are used to designate parts throughout the various figures. FIG. 1 illustrates an example of the sort of radiographic device, the computerized tomography (CT) scanner, that typically utilizes the type of high intensity x-ray tube that requires continuous heat removal, and in which the current invention finds particular application. It will be appreciated that while embodiments of the invention are described in connection with a CT scanner, the current invention could also be used in connection with other similar devices that use similar x-ray tubes and in which heat removal is of particular concern.

The CT scanner of FIG. 1, designated generally at 10, includes a patient region 12 in which a patient assumes a stationary position during a CT scanning procedure. The scanner 10 also includes a gantry 14, which is mounted and positioned for rotation about the patient region 12 during operation of the scanner. Mounted on the gantry 14 is an x-ray tube housing 16, which contains a high intensity x-ray tube (not shown), and a cooling system 18. The housing 16 and cooling system 18 are interconnected in a closed circulation circuit by way of fluid tubing, shown as outlet fluid conduit 20 and an inlet fluid conduit 22. While the illustrated embodiment shows a CT scanner having the x-ray tube housing 16 and the cooling system 18 both mounted on the rotating gantry 14, it will be appreciated that the invention can be employed in CT scanners which instead have the x-ray tube housing mounted on the gantry and the cooling system located at a stationary point on the scanner. Alternatively, the x-ray tube housing assembly and the cooling system could be integrated as a single unit. Different mounting schemes could also be utilized if the present invention were utilized in radiographic equipment other than a CT scanner.

During a typical CT scanning procedure, the high intensity x-ray tube generates a planar beam of radiation through an x-ray port (not shown) to the patient region 12. This beam of radiation is then rotated around the patient's body by rotating the gantry 14. Radiation detectors 26, which are disposed about the patient region 12, are then used to detect the intensity of the resultant radiation beam. This information can then be used to generate an image slice of the patient's body in a manner that is well known in the art.

As already discussed in the background section, in the course of generating radiation beams, an extreme amount of heat is dissipated by the x-ray tube as a by-product. In the embodiment illustrated, this heat is removed by way of the cooling system 18. During operation, the cooling system 18 continuously circulates a coolant, such as a dielectric oil or any other suitable coolant liquid or fluid, through the x-ray tube housing 16 by way of the inlet fluid conduit 22 and the outlet fluid conduit 20. As the x-ray tube generates heat, it is absorbed by the coolant fluid present within the housing 16. The heated coolant is then circulated out from the x-ray tube housing 16 back to the cooling system 18, and then cooled (in a manner described in more detail below). The coolant is then recirculated by the cooling system 18 back to the x-ray tube housing 16. This process is continued throughout the operation of the CT scanner.

Figure 2:
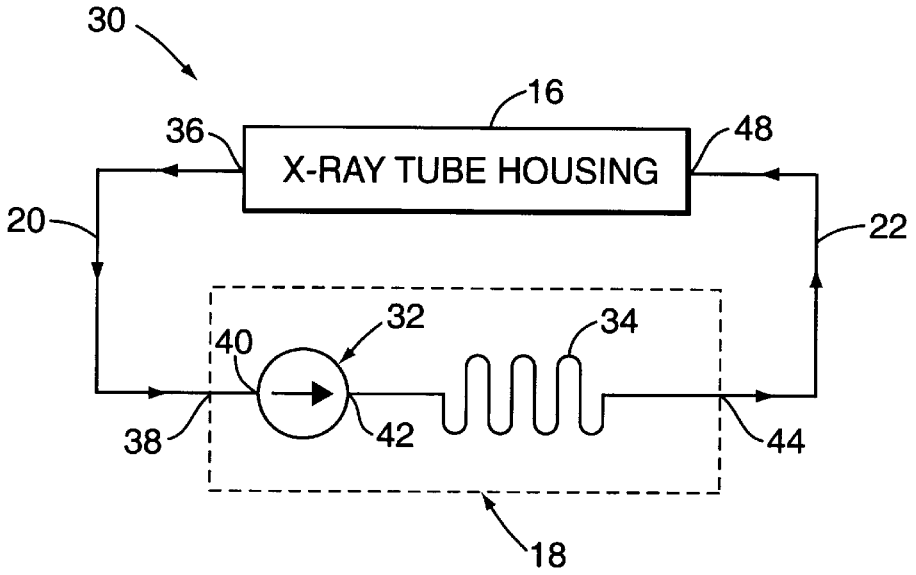
FIG. 2 is a schematic showing the closed circulation circuit and the coolant flow within the cooling system of the present invention.

FIG. 2 shows additional details of the coolant fluid flow within the closed circulation system circuit, which is designated generally at 30. As is indicated by the fluid flow arrows, during operation of the CT scanner 10, the coolant is continuously circulated between the cooling system (represented as at the dotted box indicated at 18) and the x-ray tube housing 16.

FIG. 2 further illustrates that in one preferred embodiment of the invention, the cooling system 18 is comprised of a means for pumping the coolant fluid, such as a dielectric oil, in a predetermined direction through the closed circulation circuit, and a means for removing heat from the coolant fluid. By way of example and not limitation, the pumping means is comprised of a centrifugal pump, designated at 32 (discussed in more detail below), and the heat removal means is comprised of a radiative surface in the form of a heat exchange (such as a radiator), which is designated at 34. In operation, the coolant fluid is received at an inlet port 40 of the pump 32 and then forwarded under positive pressure out of pump outlet port 42 to heat exchange 34. While any one of a number of different cooling schemes could be utilized, in the illustrated embodiment the heated coolant is passed through the heat exchange 34, and air is passed over the heat exchange 34 surface so as to dissipate heat from the coolant fluid. A fan, or fans (not shown) can be used to increase the efficiency of the heat exchange by passing cool air over the heat exchange 34 and then facilitating the removal of the dissipated heat to an external location. Once cooled, the coolant fluid is then circulated out heat exchange 34 and cooling system 18 via outlet port 44 and returned back to the x-ray tube housing 16. The circulation process continues so as to maintain the temperature of the x-ray tube below a maximum temperature.

Figure 3:
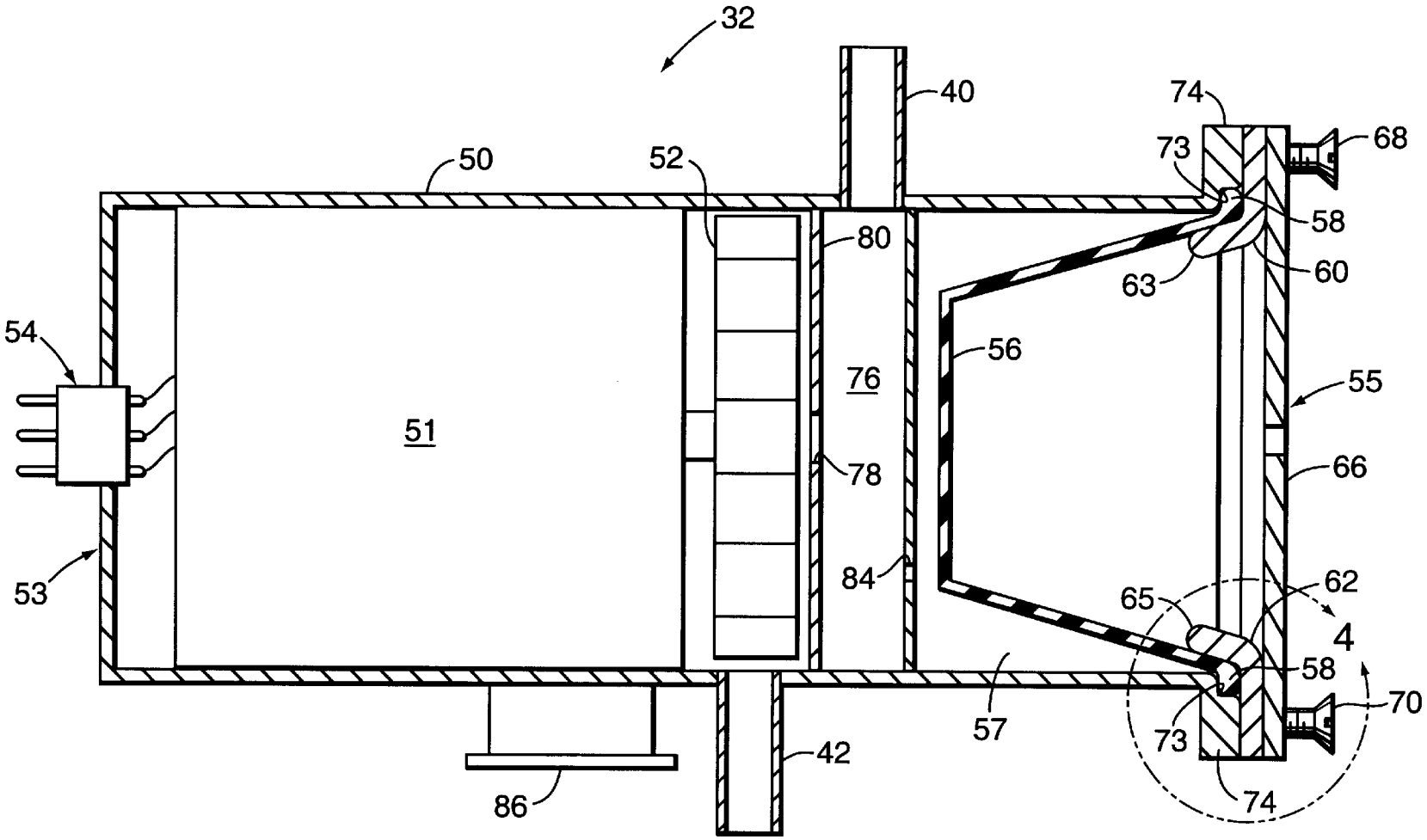
FIG. 3 is a sectional drawing of one preferred embodiment of the present invention.

Reference is next made to FIG. 3, which illustrates in further detail an example of a preferred embodiment of the pump 32 shown in FIG. 2. Pump 32 includes a cylindrical outer housing 50 that serves to enclose and hermetically seal the interior components of the pump 32. Enclosed within the pump housing 50 is an electrical pump motor 51 that drives a standard pump impeller 52. In the preferred embodiment the centrifugal pump 32 utilizes a pump motor with a wetted stator and rotor. In will be appreciated that other designs can also be used, including a motor with a wet rotor and a dry stator, or an impeller and rotor functioning as one component and/or a wet or dry stator.

In the illustrated embodiment, the pump motor 51 receives electrical power through an electrical connection provided via a hermetically sealed electrical wiring harness and plug arrangement, which is designated at 54. Any pump designs incorporating a dry stator would not require a hermetically sealed electrical wiring arrangement.

In the example embodiment, the pump housing 50 is in the form of a cylinder that is open on both ends. A first end 53 includes a small round opening through which the above-mentioned hermetic electrical connector 54 is passed. The opposite end 55 of the cylindrical housing 50 forms a hollow interior space 57. Pump 32 further includes a pump inlet 40 that is formed through the wall of the pump housing 50, and which is in fluid communication with the inlet conduit 20 in FIG. 2, so as to be capable of receiving coolant fluid from the x-ray tube housing 16. The pump 32 also includes a discharge outlet 42, also formed through the wall of the pump housing 50. In operation, the impeller 52 portion of the pump rotates in a manner so as to discharge the coolant fluid out of the discharge port 42 of the pump under pressure, in a manner that is well known in the art.

In the preferred embodiment, the pump 32 also includes an impeller plate 80, which functions to prevent the coolant fluid from being circulated between the inlet 40 and the discharge outlet 42 of the pump 32. Impeller plate 80 has formed therein an inlet hole 78. In operation, as coolant fluid enters inlet 44, it flows into the inlet chamber 76 formed within the hollow interior space 57 of the pump 32. The fluid then enters the impeller 52 chamber of the pump via the inlet hole 78, and is discharged through the discharge port 42 by the rotating impeller 52.

As was noted in the background section above, when an x-ray tube is generating radiation, both the temperature, pressure and the volume of the coolant fluid within the closed circulation system increase. Thus, the closed circulation system must include a facility to accommodate the volume changes in the closed system. Thus, the preferred embodiment of the invention includes means for accommodating volume changes within the closed circulation system illustrated in FIG. 2. Moreover, the volume accommodation means is formed as an integral part of the pump means. By way of example, and not limitation, one example of a volume accommodation means is shown in FIG. 3 as comprising an accumulator bellows 56, which is disposed within the pump housing 50. The bellows 56 is cylindrical in shape, and is constructed from a flexible material so as to be deformable and thereby accommodate any increases in volume within the closed circulation system such as would occur when the coolant is heated. In the illustrated embodiment the bellows 56 is formed from a rubber material, but could also be constructed from any other material or combination of materials that expands under pressure. For instance, a bellows constructed from metal could be utilized if it were configured so as to expand when the coolant volume is increased.

Figure 4:
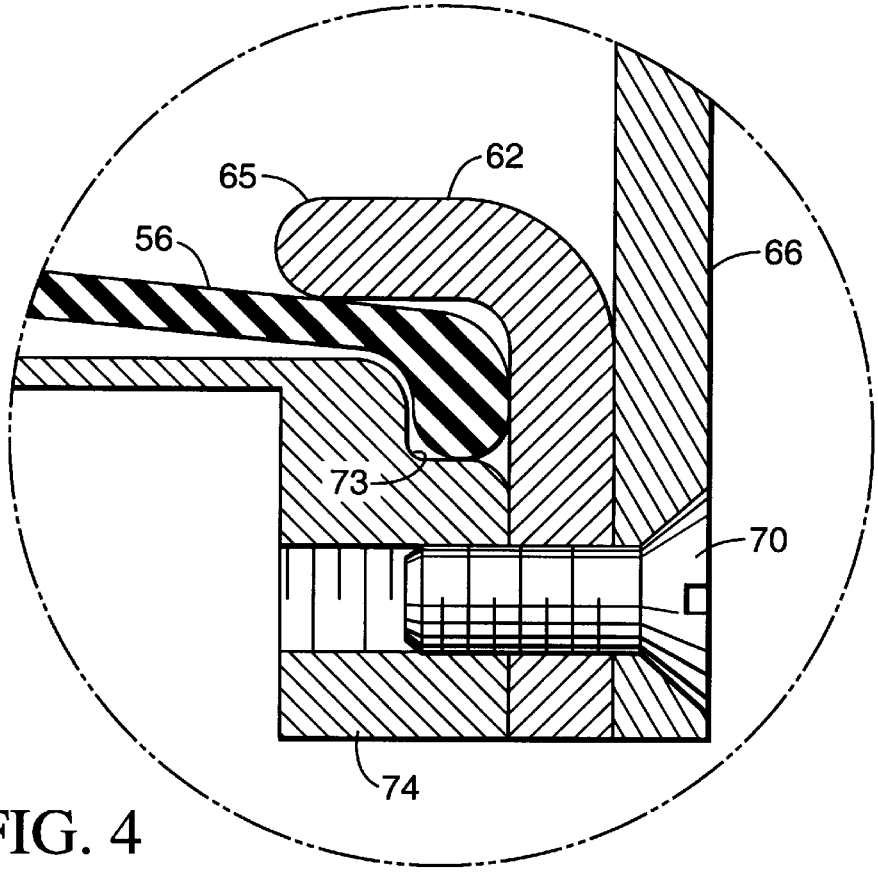
FIG. 4 is a blow-up of a part of FIG. 3 encompassed by the line 4—4 of FIG. 3, illustrating in further detail aspects of a preferred embodiment of the present invention.

In the illustrated example, the bellows 56 includes a molded integral O-ring 58 formed around the base of the cylindrical bellows 56. Formed around the circumference of the cylindrical opening formed by the pump housing 50 is an shoulder region 74 having a slightly larger diameter that the rest of the pump housing cylinder 50. The interior of the shoulder region 74 forms an O-ring gland 73. When positioned within the pump housing 50, the O-ring 58 is seated within the O-ring gland 73. This is shown in greater detail in FIG. 4. In the preferred embodiment, the bellows 56 is then secured within the pump housing 50 by way of two accumulator retainers, shown at 60 and 62. The accumulator retainers 60, 62 each include a retaining lip 63, 65 that functions so as to compress and retain the molded O-ring 58 portion within the O-ring gland 73. Moreover, when retained in this fashion, the O-ring 58 forms a fluid-tight seal.

While other securing means could be utilized, in the illustrated embodiment the retainers 60, 62 are each secured to the pump housing 50 in a manner so as to retain the bellows 56 by way of a pump housing cover plate 66 that is placed over the open end 55 of the pump housing 50. The cover plate 66 is held in place with screws 68, 70 that are inserted through corresponding threaded holes on the cover plate 66 and the shoulder region 74 of the housing 50.

Referring again to FIG. 3, since the bellows 56 disposed within the pump 32 is deformable, the illustrated embodiment further includes a means for preventing the bellows from blocking the coolant fluid from entering the pump impeller 52. In the illustrated embodiment, this is accomplished by way of a round plate 82 which is secured to the interior of the pump housing 50 walls. The plate 82 includes an oil bleed-through hole 84, through which fluid can pass between the inlet pump chamber 76 and the bellows 56. In operation, an increase in fluid volume within the closed fluid circuit can be easily accommodated by the cooling system of the present invention. Specifically, coolant fluid can pass through the bleed-through hole 84 formed in plate 82. To the extent extra volume within the closed system is required, the bellows 56 will deform in an appropriate manner. Moreover, expansion and contraction of the bellows will not impede fluid flow through the closed system.

As can be seen, the present invention provides a cooling system in which increases in fluid pressure and volume that occur as a result of increased heat dissipation are easily accommodated. The function is provided by way of a pump having an integrated accumulator, which eliminates the need for a separate and discrete accumulator component within the closed system. This simplifies the overall system due to a reduction of parts, and further enhances the reliability of the overall system because the potential for fluid leaks is reduced.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. A system for cooling an x-ray tube, the system comprising:

an x-ray tube housing containing an x-ray tube for use in a radiographic device, the x-ray tube housing being capable of receiving a coolant fluid that absorbs heat dissipated by the x-ray tube;

a heat exchange device that is capable of removing at least some of the heat absorbed by the coolant fluid;

a closed fluid circuit interconnecting the x-ray tube housing and the heat exchange device; and a pump connected within the closed fluid circuit so as to continuously circulate the coolant fluid between the x-ray tube housing and the heat exchange device, the pump further comprising means for accommodating changes in coolant fluid volume within the closed fluid circuit.

2. The system as defined in claim 1, wherein the heat exchange device is a radiative surface in the form of a radiator.

3. The system as defined in claim 1, wherein the volume accommodation means of the pump comprises a deformable accumulator, disposed within a housing of the pump so as to be in fluid communication with the closed fluid circuit, that is capable of expanding or contracting in accordance with changes in the coolant fluid volume within the closed fluid circuit.

4. The system as defined in claim 3, further comprising means for preventing the deformable accumulator from interfering with the flow of coolant fluid through the pump.

5. In a radiographic device utilizing an x-ray tube, a cooling system for cooling the x-ray tube during its operation, the cooling system comprising:

a closed fluid circuit interconnecting an x-ray tube housing containing the x-ray tube and a heat exchange device, the fluid circuit containing a coolant fluid that absorbs heat dissipated by the x-ray tube and wherein at least a portion of the heat is removed from the coolant fluid at the heat exchange device; and means for continuously circulating under pressure the coolant fluid in a predetermined direction through the closed fluid circuit in a manner so that heated coolant is received from the x-ray tube housing and coolant cooled at the heat exchange device is returned to the x-ray tube housing, and wherein the circulating means including means for accommodating changes in coolant fluid volume within the closed fluid circuit.

6. The system as defined in claim 5, wherein the coolant fluid is a dielectric oil.

7. The system as defined in claim 5, wherein the heat exchange device is a radiator capable of removing at least some of the heat absorbed by the coolant fluid from the x-ray tube and outputting a coolant having a lower temperature for return to the x-ray tube housing.

8. The system as defined in claim 5, wherein the circulating means is comprised of a centrifugal pump connected within the closed fluid circuit, and wherein the accommodating means is comprised of a deformable bellows that is disposed within a housing of the pump and that is capable of expanding or contracting in accordance with changes in the coolant fluid volume within the closed fluid circuit.

9. A radiographic device comprising:

an x-ray tube housing containing an x-ray tube, the x-ray tube housing comprising:

an inlet port for receiving a coolant fluid that is capable absorbing at least some heat dissipated by the x-ray tube during operation; and an outlet port for outputting coolant fluid that has been heated by heat dissipated by the x-ray tube;

a heat exchange device capable of removing at least some of the heat absorbed by the heated coolant fluid and then outputting a coolant having a lower temperature for return to the inlet port of the x-ray tube housing;

a closed fluid circuit interconnecting the x-ray tube housing and the heat exchange device; and a centrifugal pump operably connected within the closed fluid circuit so as to continuously circulate heated coolant fluid from the x-ray tube housing to the heat exchange device, and cooled coolant from the heat exchange to the x-ray tube housing, the pump further comprising a deformable accumulator that is disposed within a housing of the pump and that is capable of accommodating changes in the coolant fluid volume within the closed fluid circuit due to changes in temperature to the coolant fluid.

10. In a radiographic device having an x-ray tube that is disposed within an x-ray tube housing that is connected within a closed fluid circuit, and through which a coolant fluid is continuously circulated between the x-ray tube housing and a heat exchange to cool the coolant fluid, the radiographic device comprising:

a centrifugal pump that is operably connected within the closed fluid circuit so as to continuously circulate under pressure the coolant fluid heated by the x-ray tube in the x-ray tube housing to the heat exchange, and the cooled coolant from the heat exchange back to the x-ray tube housing, the pump having formed as an integral component an accumulator connected in fluid communication with the closed fluid circuit, the accumulator being capable of accommodating changes in the coolant fluid volume occurring within the closed fluid circuit due to changes in coolant fluid temperature.

* * * * *